US005988905A

United States Patent [19]

Abe et al.

[11] Patent Number: 5,988,905

[45] Date of Patent: Nov. 23, 1999

[54] PRINTING MACHINE HAVING MOVABLE POSITION SENSOR AND PAPER WIDTH GUIDE

[75] Inventors: Kouzo Abe, Tokyo; Hiromi Hibino, Machida, both of Japan

[73] Assignee: Citizen Watch Co. Ltd., Tokyo, Japan

[21] Appl. No.: 09/165,341

[22] Filed: Oct. 2, 1998

[30] Foreign Application Priority Data

Oct. 6, 1997 [JP] Japan ..... 9-287642
Oct. 6, 1997 [JP] Japan ..... 9-287643

[51] Int. Cl.[6] ..... B41J 11/42

[52] U.S. Cl. ..... 400/613; 400/708; 400/642; 101/288

[58] Field of Search ..... 400/613, 642, 400/579, 619, 708, 708.1, 709, 709.1, 636; 101/288

[56] References Cited

U.S. PATENT DOCUMENTS 4,027,590 6/1977 Seidl et al. ..... 101/288
4,418,618 12/1983 Huggins et al. ..... 101/288
5,069,562 12/1991 Matsuda ..... 101/288

*Primary Examiner*—Christopher A. Bennett
*Attorney, Agent, or Firm*—Smith, Gambrell & Russell

[57] ABSTRACT

A printing machine comprising a conveyance path for conveying printing paper, and a position sensor for detecting the end of the printing paper passing through the conveyance path. Printing is carried out at a prescribed position on the printing paper, in accordance with this position sensor. The position sensor is located movably in a transverse direction to the conveyance path. It can be withdrawn to a position where it poses no obstacle when setting printing paper in the conveyance path.

16 Claims, 8 Drawing Sheets

PRINTING MACHINE HAVING MOVABLE POSITION SENSOR AND PAPER WIDTH GUIDE

BACKGROUND OF THE INVENTION

1. Field of the Invention

The present invention relates to a printing machine which conducts printing while winding out labels wound in a roll with a backing paper, or continuous tags wound in a roll, or receipt paper wound in a roll, or the like (hereinafter, referred to generally as "rolled printing paper").

2. Description of the Related Art

In order that continuous tags, or the like, wound out from a roll (hereinafter, simply referred to "printing paper") are guided correctly to the printing position of a printing machine, and that printing is conducted at the correct position on the printing paper with good timing, a printing machine is provided with a printing paper width guide, which is adjustable according to the width dimension of the paper, and a position sensor for detecting a prescribed position of the printing paper, located in the conveyance path of the printing paper.

Since the position detection sensor will pose an obstacle to paper setting if it is positioned above the conveyance path of the printing paper, it is located either beneath the conveyance path, or to one side thereof. Therefore, the composition becomes complex and it becomes impossible to detect the position of the printing paper accurately.

For example, when printing on tags, string attachment holes located centrally in the transverse direction of the tags may be detected to locate the printing position, but usually, even if the tag width dimensions are changed, this string attachment hole will always be in a central transverse position. Consequently, when the width of the printing paper changes, the central position of the printing paper with respect to the printing machine also changes, and therefore it is necessary to move the positional sensor at the same time as moving the printing paper width guide in accordance with the printing paper width.

Moreover, since the printing paper width guide and the position sensor must be positioned such that they project into the paper conveyance path, they present an obstacle when the printing paper is set at the start of the printing operation. Because the paper width guide can be adjusted in accordance with the width of the printing paper, it does not present a significant obstacle if it is set to maximum width in advance, but since the position sensor should desirably be located in a position where it can detect the central portion of the printing paper, it presents a particular obstacle.

A printing machine is also provided with guide rollers for guiding the printing paper accurately into the paper conveyance path. Furthermore, a paper sensor for detecting the end of the printing paper is also provided, in order to halt operation of the printing machine when the whole roll has been wound out and the printing paper has run out.

However, such guide rollers and paper sensors are located close to the paper conveyance path and when fresh printing paper is loaded into the printing machine, a problem arises in that the printing paper must be inserted into a narrow gap between the guide roller and paper sensor and the paper conveyance path.

In Japanese Patent Laid-open No. Hei. 8-58168, a paper holder supported by arms on either side is installed rotatably in a frame, such that the printing paper sensor can project into and withdraw from the paper conveyance path with the rotation of the head holder. Accordingly, it seems this prior art has resolved the problems associated with loading new printing paper into the printing machine.

However, even in this printing machine, the leading end of a new roll of printing paper must be inserted inbetween the arms positioned on either side, and therefore the paper setting operation is still difficult. Moreover, since the rolled printing paper is inserted from the roll directly inbetween the head holder and platen, no guide roller is provided to keep the position of the printing paper stable at this point.

OBJECTS AND SUMMARY OF THE INVENTION

It is an object of the present invention to provide a printing machine whereby printing paper can be set readily, without a position sensor presenting an obstacle during paper setting.

The printing machine according to the present invention is a printing machine comprising a conveyance path for conveying printing paper, a position sensor for detecting a prescribed position of printing paper on the conveyance path, and a printing paper width guide, which is movable in a transverse direction to the conveyance path, for restricting the position of printing paper of a desired width in a transverse direction to the conveyance path, wherein the position sensor is attached to a sliding member composed such that it can slide in a transverse direction to the conveyance path together with the printing paper width guide.

According to the present invention, since the position sensor is located on the paper conveyance path, it is capable of detecting a prescribed position on the printing paper accurately. Furthermore, it can be set to a position withdrawn from the conveyance path when setting the printing paper, and therefore poses no obstacle when setting printing paper.

In one embodiment of the present invention, the movement of the position sensor is coupled to the movement of the paper width guide, which is convenient in cases where the position of the position sensor needs to be adjusted in accordance with change in the width of the printing paper. Moreover, in cases where the position detection sensor detects an element, such as a string attachment hole in a tag, which is always positioned in the center of the width dimension of the printing paper even if the width dimension of the printing paper changes, the position sensor is adjusted simultaneously, simply by adjusting the position of the printing paper width guide in accordance with change in the printing paper width, and therefore the adjustment operation can be carried out smoothly.

Furthermore, the structure for withdrawing the position sensor from the conveyance path can be composed simply. A light-emitting element and a light-receiving element can be located in stable positions, and positions on the printing paper can be detected accurately.

The action of returning the position sensor to its original position from its temporary withdrawn position during paper setting involves a simple operation, which gives good convenience in use. During operation, the position sensor can be held stably in a fixed position.

Moreover, the printing machine according to the present invention is a printing machine comprising a conveyance path for conveying printing paper, a position sensor for detecting a prescribed position of printing paper on the conveyance path, and a printing paper width guide, which is movable in a transverse direction to the conveyance path, for restricting the position of printing paper of a desired width in a transverse direction to the conveyance path, wherein the portion of the conveyance path comprising the position sensor, the printing paper width guide, the paper sensor and the guide roller is formed in an approximately linear shape.

According to one embodiment of the present invention, in a printing machine, since a guide roller for positioning printing paper on a platen in a orderly state can be moved to a position withdrawn from the conveyance path, it is possible to set printing paper readily, without complicated tasks, such as passing the printing paper through a narrow gap, or the like. Furthermore, since the paper sensor for detecting the end of the printing paper can be set to a withdrawn position simultaneously with the guide roller, the printing paper can be set more easily, without the setting of printing paper being obstructed by the paper sensor.

Moreover, since the guide roller can be set to a withdrawn position by rotating it by holding the other end thereof, the operation is straightforward and the composition is also relatively simple.

Furthermore, since the paper sensor has a mechanical detection structure and comprises a lever shape which is rotatable about a guide roller shaft, the end of the printing paper can be detected reliably by means of a simple structure.

Since the detection operation by the paper sensor is carried out by means of a lever-shaped detecting section falling into a groove in the conveyance path, its operation is straightforward, and the end of the printing paper can be detected reliably.

Since the operating position of the guide roller can be maintained by means of locking members, the function of guiding the printing paper can be stabilized and the printing paper can be guided smoothly to the printing position.

Since the vertical rotational position of the guide roller can be held stably in an upper position or a lower position by means of a reversing spring, operability is good, for instance, both hands can be used to set the printing paper.

BRIEF DESCRIPTION OF THE DRAWINGS

The foregoing and other objects and features of the invention will become apparent from the following description of a preferred embodiment of the invention with respect to the accompanying drawings, in which.

DETAILED DESCRIPTION OF THE PREFERRED EMBODIMENTS

Figure 1:
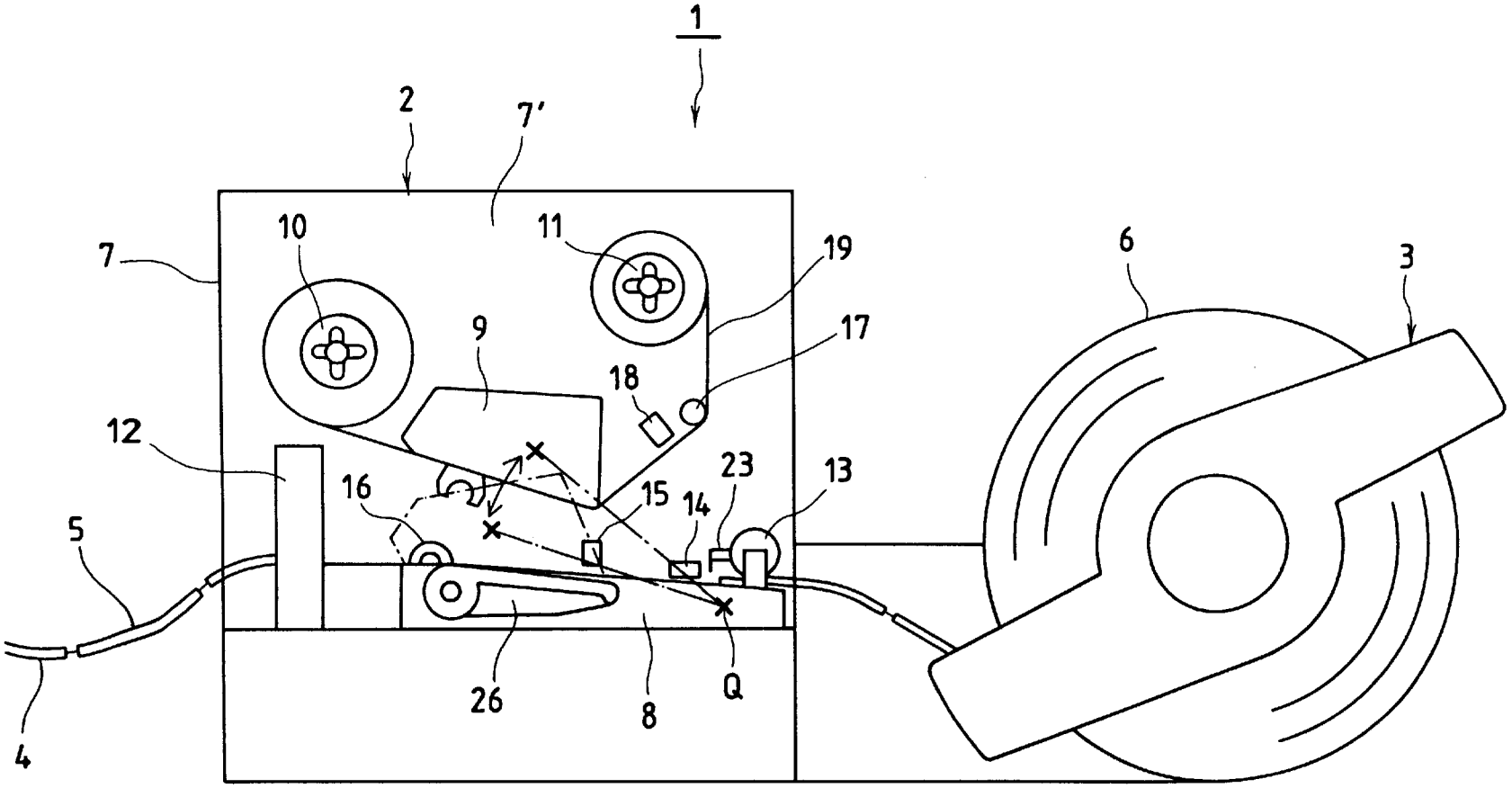
FIG. 1 is a front view giving an approximate view of a printing machine according to the present invention.

An overview of a printing machine 1 is now described with reference to FIG. 1.

The printing machine 1 comprises a main unit 2 and a printing paper supply reel 3. Rolled printing paper 6 comprising a continuous tag 4 wherein tags 5 are connected together is installed on the printing paper supply reel 3. The main unit 2 comprises a paper conveyor head 8, a thermal transfer-type printing head 9, a take-up side ink ribbon reel 10, a supply-side ink ribbon reel 11 and a printing paper cutter 12, these elements being installed on a main unit frame 7.

Furthermore, the main unit 2 comprises, in order from the printing paper supply side along the conveyance path on the upper face of the conveyance head 8, a printing paper guide roller 13, a paper sensor 23 for detecting the position of a prescribed portion of the printing paper (for example, the end portion thereof), a printing paper width guide 14, a position sensor 15 for detecting a precise printing position on the tags, and a platen 16.

The main unit 2 is also provided with a ribbon guide 17 for restricting the path of the ink ribbon and a ribbon detection sensor 18, located in the vicinity of same. An ink ribbon 19 is wound from a ribbon roll provided on the supply-side ink ribbon reel 11, via a ribbon guide 17 and the lower face of a printing head 9, and onto a take-up side ink ribbon reel 10.

Figure 2:
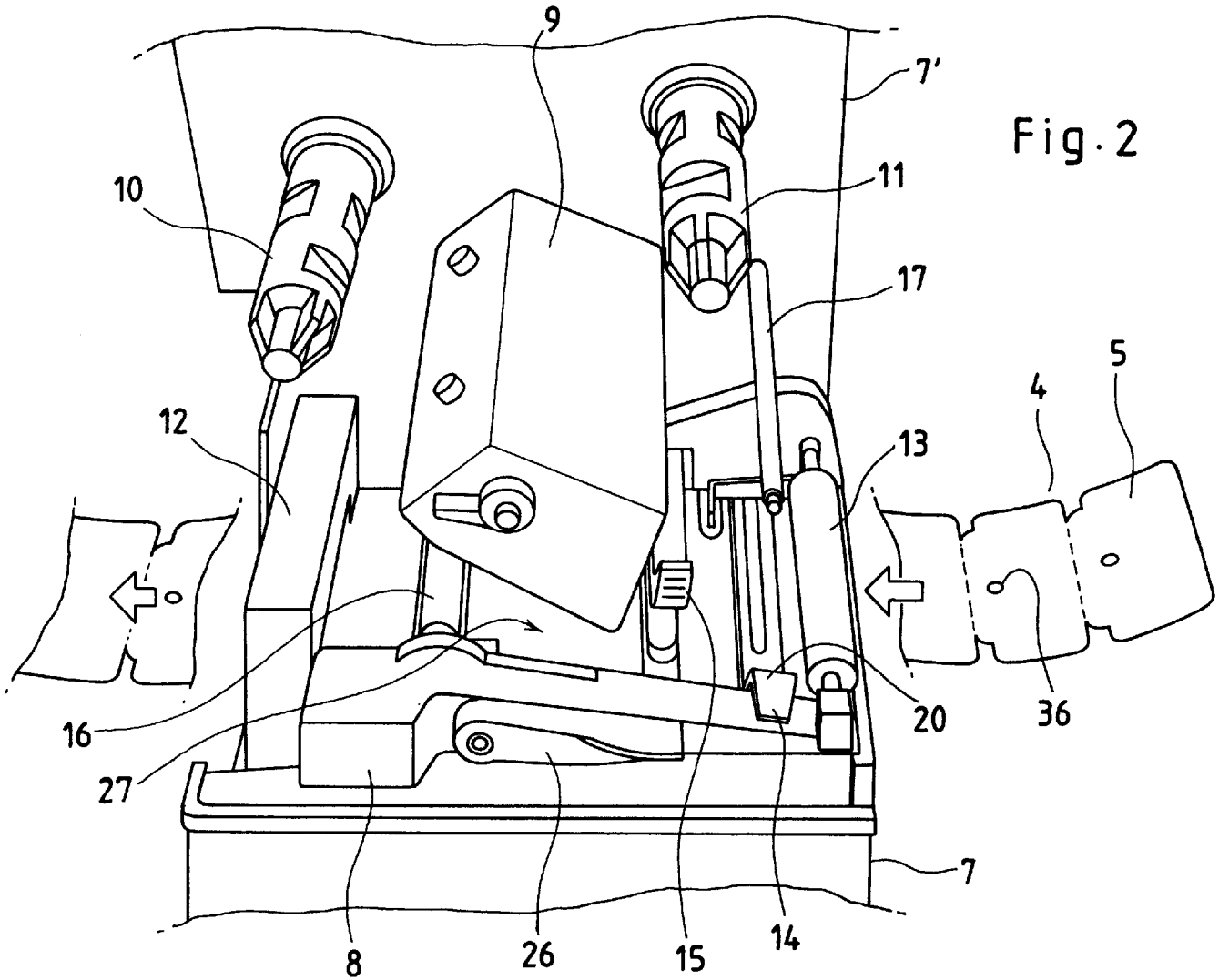
FIG. 2 is an oblique view showing the principal parts of the printing machine in FIG. 1.

As shown in FIG. 2, the printing head 9, guide roller 13, take-up ink ribbon reel 10, supply-side ribbon reel 11 and ribbon guide 17 are each supported by shafts, one end of which is fixed to a vertical wall 7' of the main unit frame 7, the other end being a free end, and they each project perpendicularly from the vertical wall 7' in a transverse direction to the conveyance path.

Figure 3:
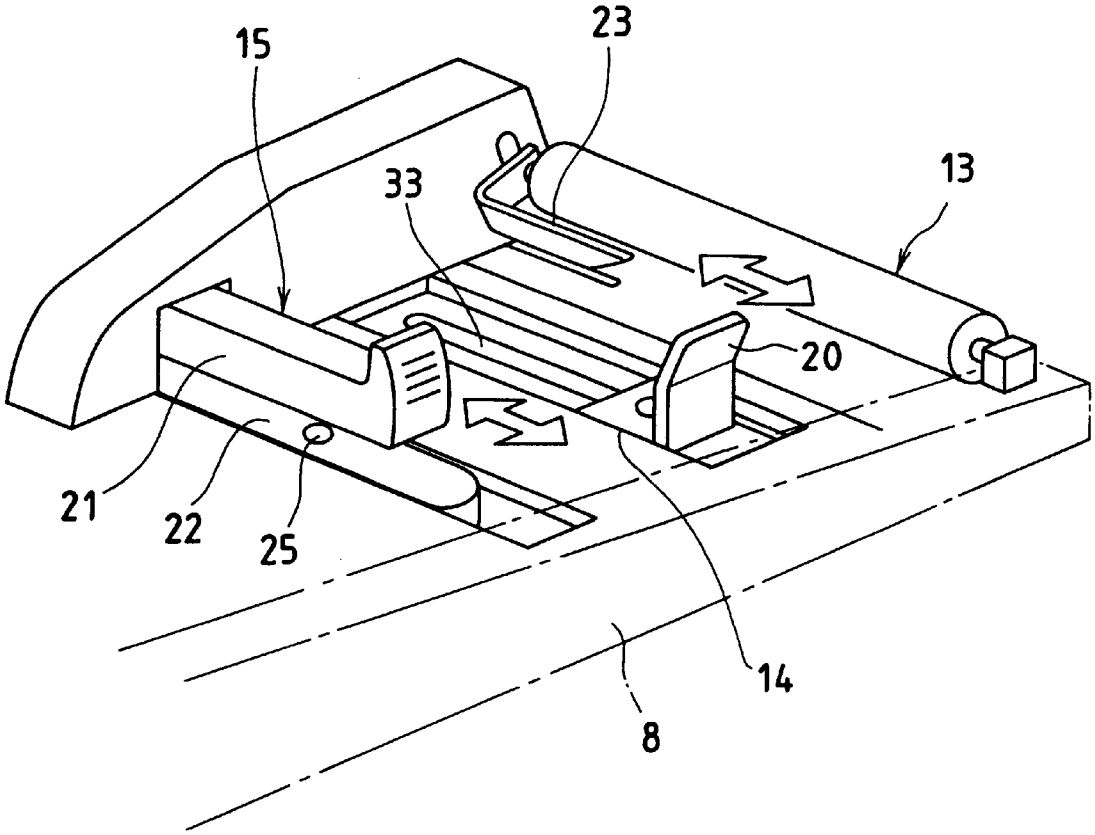
FIG. 3 is an oblique view showing a portion of a position sensor of a printing machine in FIG. 1.
Figure 4:
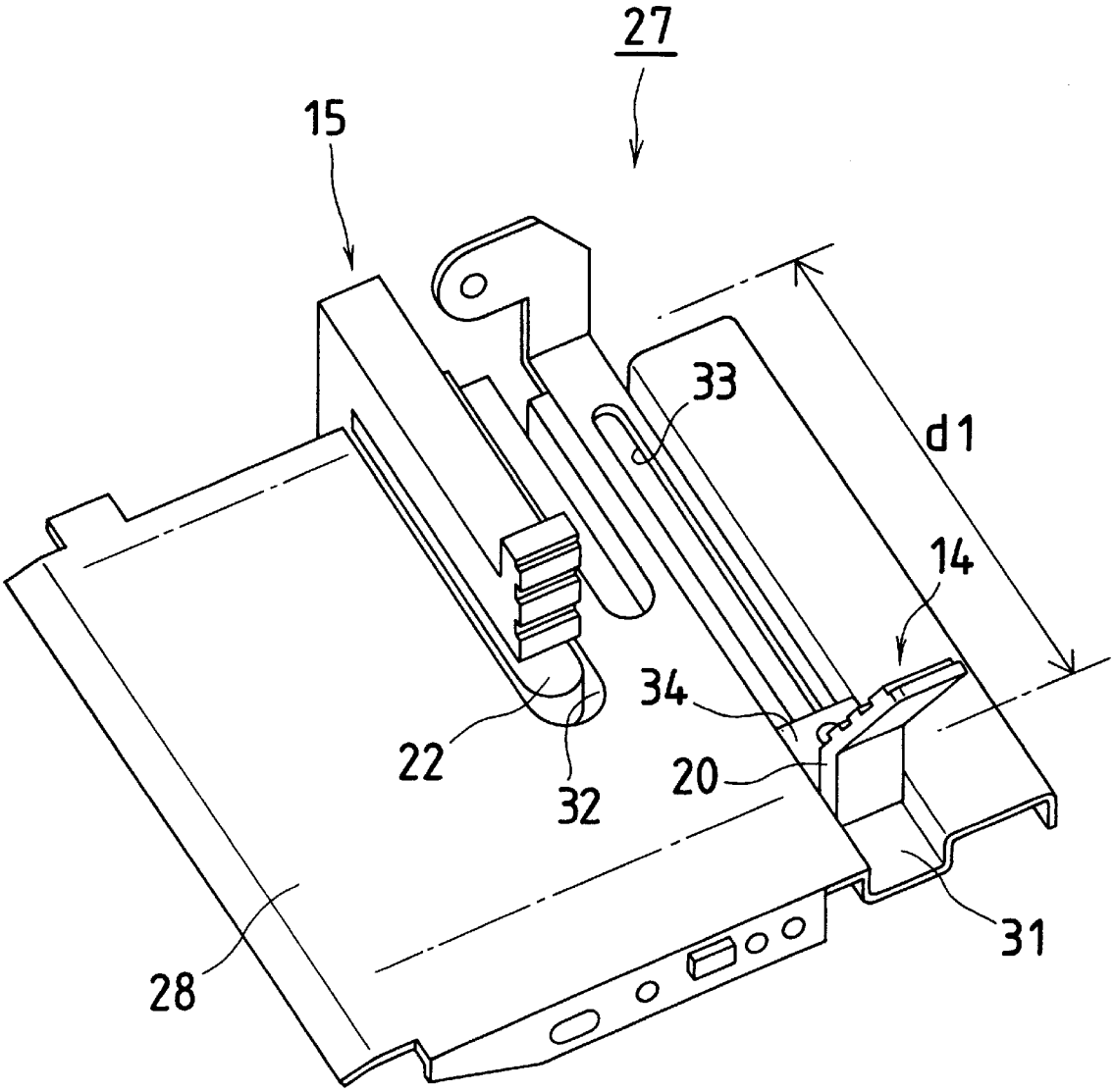
FIG. 4 is an oblique view showing the printing paper width guide and the position sensor in the printing machine in FIG. 1 formed into a single unit by assembly onto a single base plate.

A raised section 20 is formed at one end of the printing paper width guide 14. By pressing this raised section 20 manually, the printing paper width guide 14 can be made to slide across the conveyance path in a transverse direction thereto and positioned at a desired position, as illustrated in FIG. 3.

The position sensor 15 is a U-shaped member comprising an upper portion 21 and a lower portion 22 positioned in opposition on the other side of a gap 24 (FIG. 6), and the rolled printing paper 6 passes through this gap 24.

A photoelectric element 25 comprising a light-emitting element and a light-receiving element located in corresponding positions to the upper portion 21 and lower portion 22 of the position sensor 15 is also provided. The photoelectric element 25 detects the string attachment hole 36 (FIG. 2) of a tag passing through the gap 24 and this detection signal is transmitted to a control device (microcomputer, not shown) provided in the printing machine.

The printing head 9 is attached to the end of an arm (indicated by the broken lines) which rotates about a shaft Q (FIG. 1) on the rear face of the vertical wall 7' of the frame 7, and it can be placed in an upper or lower position by operating a handle 26 provided in the front face of the conveyor head 8. In FIG. 1, the printing head 9 (solid lines) is in a state where it has been moved upwards so that printing paper can be readily loaded, and if the handle 26 is rotated upwards from this state, then the printing head 9 is pulled downwards about shaft Q by means of a linking mechanism (not shown) provided on the rear face of the perpendicular wall 7' of the frame 7, and it assumes a state wherein the thermal transfer head presses lightly against the platen 16.

When the printing head 9 is pulled down, since the printing paper is already loaded, the printing paper is held between the platen 16 and the thermal transfer head, and printing is carried out. Having been pulled downwards, the printing head 9 is held in a downward position by means of a hook mechanism (not shown) engaging with the side of the handle 26, until the handle 26 is operated again.

Next, the printing paper width guide 14 and position sensor 15 are described with reference to FIG. 4 to FIG. 7.

The paper width guide 14 and the position sensor 15 constitute a single unit 27 by being assembled onto a single base plate 28. This unit 27 also includes members, such as a linkage lever 30, and the like.

The base plate 28 is a pressed component and the upper face thereof constitutes a printing paper conveyance path (of width d1) up to the platen 16. Moreover, a guide groove 31 traversing the conveyance path, and a cutout section 32 extending similarly in a transverse direction up to approximately the midpoint of the width of the conveyance path are formed in the base plate 28. A rail hole 33 is formed on the bottom side of the guide groove 31 extending in the longitudinal direction of the groove. The cut-out section 32 is open on the side of the vertical wall 7' of the main unit frame 7.

The printing paper guide 14 is a resin component, and it comprises a horizontal section 34 and a raised section 20. A first pin p1 (FIG. 5) projects from the lower face of the horizontal section 34. This first pin p1 projects through a rail hole 33 and into the lower side of the guide groove 31. A fastening plate 35 (FIG. 5) is attached to the projecting end of the first pin p1, thereby preventing the first pin p1 from being disconnected from the rail hole 33, whilst also enabling the first pin p1 to move in a linear direction in the guide groove 31.

As well as functioning as a face which restricts one edge of the printing paper, the raised section 20 of the printing paper guide 14 is formed into an operating knob at the upper end thereof.

Figure 6:
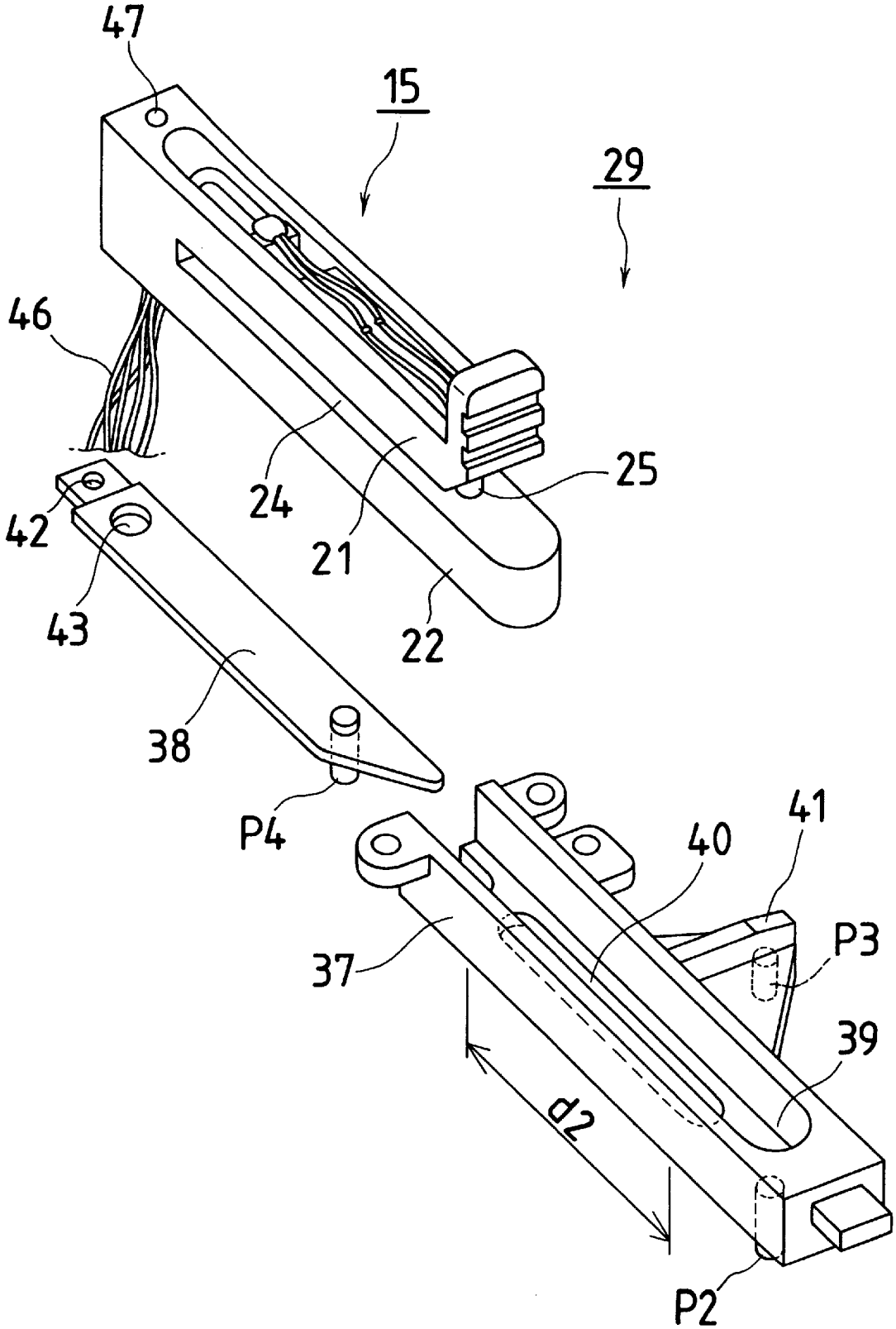
FIG. 6 is a view of the position sensor in FIG. 4 in a disassembled state.

In the position sensor 15, a sensor unit 29 is constituted by combining a base part 37 with a sliding plate 38, as illustrated in FIG. 6. The base part 37 is a resin molded component which extends in a transverse direction to the paper conveyance path, and its length is approximately half the width (d1) of the conveyance path. An installation groove 39 is formed longitudinally in the base part 37. This installation groove 39 is open on the upper face thereof as well as on the side of the vertical wall 7' of the main unit frame 7. A long groove 40 of length d2 is formed in the base portion of the installation groove 39.

Moreover, a second pin p2 projects downwards from the under side of the base part 37 at the end portion thereof. Furthermore, a stay 41 extends from one side of the base part 37 and a third pin p3 projects downwards from the end portion of this stay 41.

The sliding plate 38 is a plate having practically the same width and length as the installation groove 39 of the base part 37. The sliding plate 38 fits into the installation groove 39 and can move longitudinally inside the installation groove 39.

A fourth pin p4 projects downwards from the under side of the sliding plate 38 at the end portion thereof. A screw hole 42 for fastening the position sensor 15 and a through hole 43 for passing a lead wire from the position sensor 15 are formed respectively in the end portion (vertical wall 7' side) of the sliding plate 38.

Figure 5:
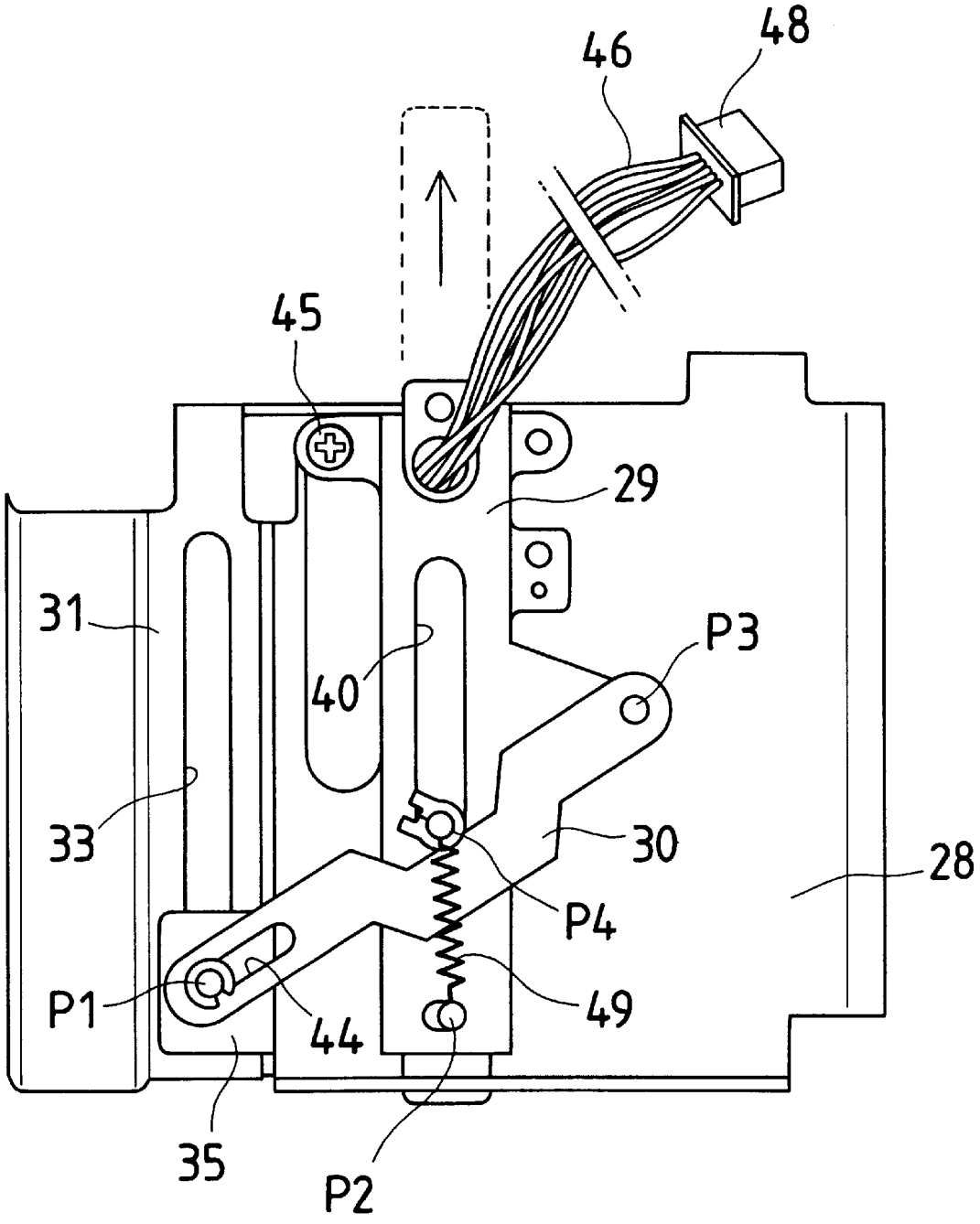
FIG. 5 is a view from the rear side of the unit in FIG. 4.

As shown in FIG. 5, a coupling lever 30 is provided on the under side of the base plate 28 to connect the first pin p1 provided on the horizontal section 34 of the printing paper width guide 14 and the third pin p3 provided on the stay 41 in the sensor unit 29. The first pin p1 and the coupling lever 30 are connected via an elongated adjustment groove 44 formed in one end of the coupling lever 30. The central portion of the coupling lever 30 lies in contact with the fourth pin p4 provided in the sliding plate 38.

The aforementioned constituent elements are assembled to form a unit 27 in the following manner.

The printing paper width guide 14 is fitted into the guide groove 31 in the base plate 28 and the first pin p1 provided in the horizontal section 34 thereof is inserted into the rail hole 33 formed in the lower face of the guide groove 31. Thereupon, the fastening plate 35 is attached to the end of the first pin p1 projecting through the rail hole 33. Thereby, the printing paper width guide 14 is able to move linearly along the guide groove 31 in a transverse direction to the paper conveyance path.

Thereupon, the sliding plate 38 is fitted into the installation groove 39 in the base part 37 of the sensor unit 29 and the fourth pin p4 provided at the end of the sliding plate 38 is inserted into the long groove 40 formed in the base portion of the installation groove 39. The base part 37 engaging the sliding plate 38 is then fixed to the base plate 28 from the under side thereof, using a plurality of screws 45, such that the installation groove 39 is aligned with the cut-out section 32 in the base plate 28.

Thereby, viewed from the upper face of the base plate 28, the sliding plate 38 can be seen through the cut-out section 32. The position sensor 15 is then mounted onto the sliding plate 38 through the cut-out section 32. A lead wire 46 from the photoelectric element 25 provided in the position sensor 15 is passed through the through hole 43 in the sliding plate 38. The screw 45 passing through the screw hole 47 formed in the position sensor 15 is screwed into the screw hole 42 in the sliding plate 38, thereby coupling the position sensor 15 and the sliding plate 38 onto the base part 37 as an integral unit.

The elongated adjustment groove 44 in the coupling lever 30 fits into the first pin p1 provided in the horizontal section 34 of the printing paper width guide 14, and the end of the coupling lever 30 on the side of the elongated adjustment groove 44 is attached rotatably to the third pin p3 provided in the base part 37 of the sensor unit 29. Furthermore, the second pin p2 provided in the lower face of the end portion of the base part 37 and the fourth pin p4 provided in the end of the sliding plate 38 (this fourth pin p4 projects through the long groove 40 formed in the lower portion of the installation groove 39, as shown in FIG. 5) are coupled by a tensile spring 49.

The fourth pin p4 is held towards the second pin p2 by the tensile spring 49 and remains in contact with the center portion of the coupling lever 34 at all times, as illustrated in FIG. 5. Moreover, the coupling lever 30 held under tension by the tensile spring 30 holds the printing paper width guide 14 to its maximum printing paper width position, normally.

In FIG. 5, numeral 48 denotes a socket, which is used to connect the lead wire 46 to a control device.

When the printing paper width guide 14 is moved toward the vertical wall 7' of the main unit frame 7, the coupling lever 30 rotates about the third pin p3 provided in the base part 37 of the sensor unit 29, and presses against the fourth pin P4 provided at the end of the sliding plate 38. Consequently, the sliding plate 38 and the position sensor 15 coupled thereto both move simultaneously toward the vertical wall 7'. The tensile spring 49 becomes stretched by this movement, and therefore the operation of returning the printing paper width guide 14 becomes light, due to the tension of the tensile spring 49, and furthermore, the position sensor 15 will also be returned to its original position with the returning movement of the printing paper width guide 14.

Figure 7:
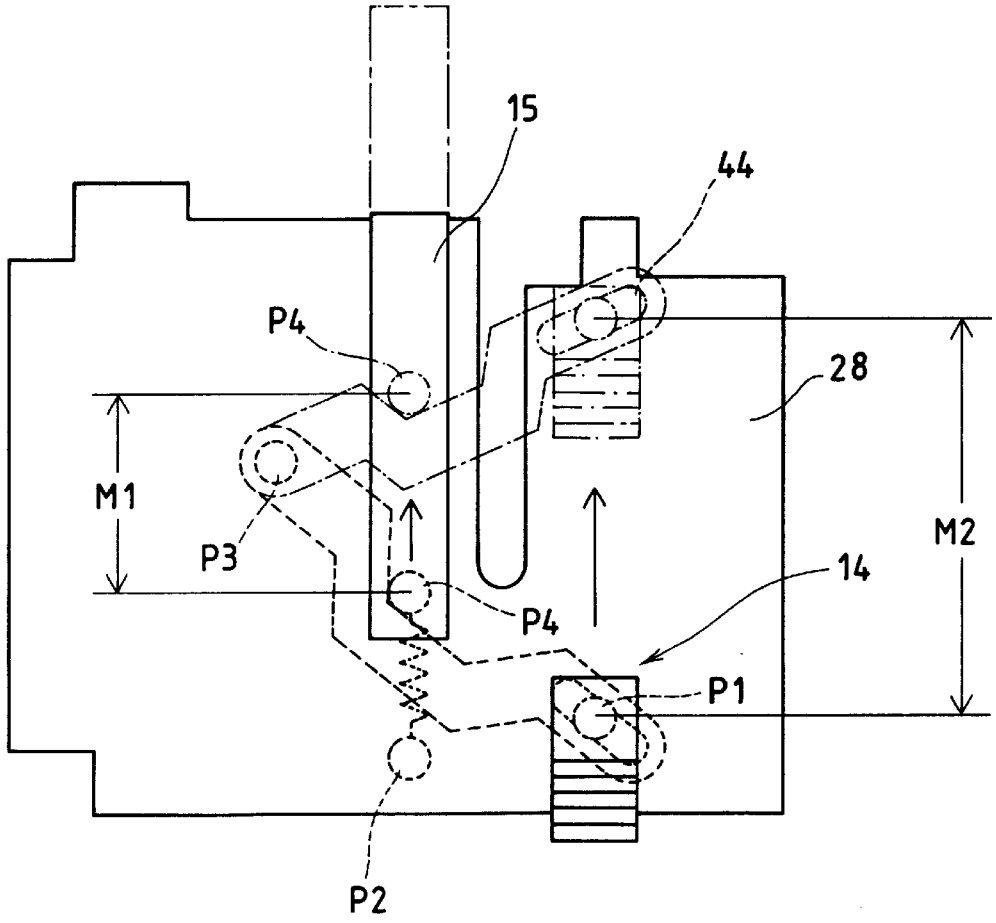
FIG. 7 is a diagram illustrating how the amount of movement of a positional sensor is half the amount of change in the width of the printing paper, when the position of a printing paper width guide is adjusted in accordance with a change in the width of printing paper.

If the rail hole 33 and the long groove 40 are provided in parallel and are constituted such that the fourth pin p4 contacts the coupling lever 30 at the midpoint of the line linking the first pin p1 to the third pin p3, as shown in FIG. 5 and FIG. 6, then the amount of movement M1 of the fourth pin p4 generated by the rotation of the coupling lever 30 about the third pin p3 will be approximately ½ the amount of movement M2 of the first pin p1, as illustrated schematically in FIG. 7.

In other words, if the position of the printing paper width guide 14 is adjusted in accordance with change in the width of the printing paper, then the amount of movement of the position sensor 15 will always be half the amount of change in the width, and furthermore, this change will be in the same direction. This means that whenever the width of the printing paper is changed, the position sensor 15 will always be located at the midpoint of the width of the paper, which is convenient in cases where, for example, the object of detection is string attachment holes in the center of tags having varying width dimensions. In addition to cases where the string attachment holes are located in the middle of the tags, a similar structure can also be used for cases where the string attachment holes are located in positions representing a fixed ratio of the paper width.

The unit 27 assembled in this way is incorporated into the main unit frame 7 as illustrated in FIG. 2.

In FIG. 1 and FIG. 2, the guide roller 13, paper sensor 23 and printing head 9 are raised upwards, the position of the printing paper width guide 14 corresponds to the maximum printing paper width, and the rolled printing paper 6 is drawn out from the printing paper supply reel 3 and the leading end thereof is passed through the gap 24 in the position sensor 15 until it reaches the platen 16.

Thereupon, the guide roller 13 and the printing head 9 are lowered, and the printing paper width guide 14 is pushed in until the raised section 20 thereof contacts one side of the printing paper, thereby restricting the sides of the moving printing paper. By so doing, with the movement of the printing paper guide 14, the position sensor 15 automatically assumes a position at the midpoint of the paper width, this being a position where string attachment holes 36 in the center of the printing paper can be detected.

The ink ribbon 19 is wound from the supply reel 11 to the take-up reel 10 via a printing head 9, and when the printing head 9 is lowered, it contacts the surface of the printing paper and is held between the platen 16 and the printing head 9.

By rotating the platen 16, the ink ribbon and the printing paper are fed and printing is carried out at a prescribed position of the printing paper on the basis of a signal from the position sensor 15. In some cases, the cutter 12 may not be used. When printing has been completed for a prescribed number of tags 5, or when the paper sensor 23 detects the end of the rolled printing paper, then, upon completion of printing onto one tag 5, the operation of the printing machine 1 halts.

Above, one embodiment of the invention was described, but it is also possible to adopt a composition wherein the connection between the printing paper width guide 14 and the position sensor 15 by means of the coupling lever 30 is disengaged and the position sensor 15 is moved to a withdrawn position by pushing it independently. In this case, if the gap between the upper portion 21 and the lower portion 22 of the position sensor 15 is set such that it is open on the side of the paper conveyance path, then the printing paper can be positioned in the gap 24 simply by returning the position sensor 15 to its original position.

Next, a structure, wherein a guide roller 13 is withdrawn from the conveyance path such that it does not form an obstacle when the printing paper is set along the conveyance path, is described with reference to FIG. 8.

The guide roller 13 has a structure comprising roller shafts 51*a* and 51*b* which project from either end of a hard roller 13' and it is placed in the frame 7 in a transverse direction to the paper conveyance path. The length of the roller 13' is approximately equal to the width of the paper conveyance path.

The paper sensor 23, on the other hand, is an L-shaped lever-type member consisting of a supporting section 52 extending in the direction of paper conveyance and a detecting section 53 extending in a transverse direction to the paper conveyance path. The supporting section 52 holds the roller shaft 51*a* of the guide roller 13 rotatably. Moreover, the roller shaft 51*a* projecting from the supporting section 52 is supported rotatably by a frame side member 60.

The frame side member 60 supporting the roller shaft 51*a* of the guide roller 13 is a member formed by plate metal processing, the lower portion thereof being supported swingably on the rear face of the vertical wall 7' of the main unit frame 7 by a shaft P which is parallel to the direction of paper conveyance. Therefore, the frame side 60 member is able to swing about the shaft P.

Furthermore, a detection sensor 70 is provided on the upper portion of the frame side member 60. This detection sensor 70 is placed opposing the end portion of the supporting section 52 of the paper sensor 23, the paper sensor 23 being capable of rotating about the roller shaft 51*a* of the guide roller 13.

Moreover, a reversing spring 61 is attached between the upper portion of the frame side member 60 and the main unit frame 7, thereby holding the frame side member 60 such that it rotates towards the supporting section 52 about shaft P.

Figure 8:
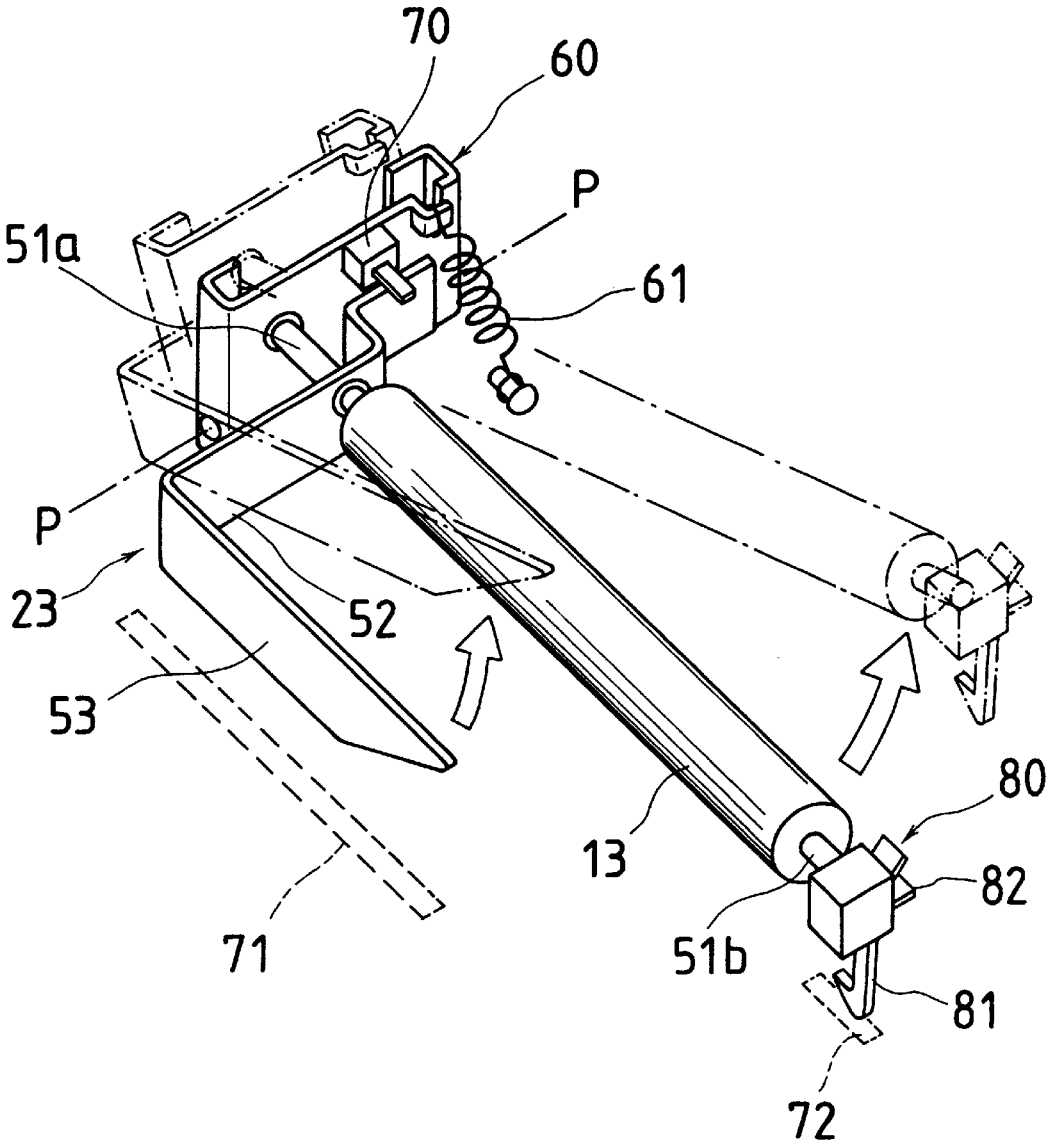
FIG. 8 is an oblique view of a guide roller and a member for supporting a guide roller in the printing machine in FIG. 1.

In the embodiment shown in FIG. 8, the detection sensor 70 attached to the frame side member 60 is a microswitch, and when the detecting section 53 of the paper sensor 23 is rotated downwards, it operates and the switch turns on. Numeral 71 denotes a groove provided in the paper conveyance path, which is formed in a position where the lower edge of the detecting section 53 of the paper sensor 23 descends.

A coupling device 80 provided with a hook 81 and knob 82 is attached to the other roller shaft 51*b* of the guide roller 13. Numeral 72 in FIG. 8 denotes a coupling hole formed in the side of the frame 7. The guide roller 13 can be lowered by manually holding the knob 82, and if the hook 81 is pushed into the coupling hole 72, then the hook 81 engages with the coupling hole 72, thereby enabling the guide roller 13 to be held in the lower position and prevented from rising up. In other words, the hook 81 and the knob 82 form locking members with respect to the frame 7. The hook 81 can be released from the coupling hole 72 by manually operating the knob 82.

When printing paper is loaded into the main unit 2 of the printing machine 1, the printing head 9 is raised from the position marked by the broken lines in FIG. 1 to the position marked by the solid lines, by manually operating the handle 26 in a downward direction, and furthermore, one end of the guide roller 13 is raised upwards (to the position shown by the broken lines in FIG. 8) by manually operating the knob 82 provided in the roller shaft 51*b*. Thereby, the guide roller 13 rotates about the shaft P together with the frame side member 60. This guide roller 13 is held stably in the upper position by the action of the reversing spring 61, even if the operator removes his or her hand.

The paper sensor 23 detecting the end portion of the printing paper is moved upwards with the guide roller 13, and the detecting section 53 is raised and separated from the conveyance surface.

Moreover, the printing paper width guide 14 is set to a position corresponding to the maximum paper width by pulling the raised section 20 thereof forward. The position sensor 15 is pressed to the frame side and is withdrawn from the conveyance path.

When the printing head 9 is moved upwards, the ink ribbon 19 becomes slack, but since the take-up side ink ribbon reel 10 is held under tension by a spring (not shown) such that it rotates in the direction of winding, the slackness in the ribbon is taken up onto the take-up side ink ribbon reel 10, thereby preventing the ink ribbon 19 from becoming loose.

Next, the leading end of the printing paper is pulled out from the rolled printing paper 6, positioned on the upper face of the conveyor head 8, and passed through the printing paper cutter 12, from which it protrudes slightly. This operation can be carried out with ease and accurately, because the space between the printing head 9 and the guide roller 13 and the paper conveyance path is opened wide on both the upper face and front face thereof, and furthermore, the position of the platen 16, which forms the printing position, can be identified.

After setting the printing paper, conversely to the procedure described above, the printing head 9 is lowered, and the printing paper is restricted between the printing head 9 and the platen 16, whereupon the guide roller 13 is lowered and the hook 81 provided on the end of the roller shaft 51*b* engages with the coupling hole 72 formed in the frame 7, thereby fixing the guide roller 13 to the frame 7. In this case, the detecting section 53 of the paper sensor 23 is also lowered, alighting upon the upper face of the loaded printing paper and being supported in this position. Here, the detection sensor 70 provided in the frame side member 60 does not operate since the paper sensor 23 never strikes the detection sensor 70.

Thereupon, the printing paper width guide 14 is adjusted to the width of the printing paper and the position sensor 15 is pulled out forwards to an operational position where the printing paper is located in the gap 24 between the upper portion 21 and the lower portion 22 thereof. When the printing head 9 is lowered, the ink ribbon 19 is drawn out from the supply side, but since there is resistance to winding out due to friction acting on the supply-side ink ribbon reel 11, there is no slackness in the ink ribbon 19.

When the printing operation starts, printing is carried out by conveying the printing paper by a unit of a printing line for the tags 5, by means of the platen 16. The amount of rotation of the platen 16 is controlled by detecting a string attachment hole 36 formed in a prescribed position on a tag 5. The ink ribbon 19 is drawn out from the supply side ink ribbon reel 11 principally by rotation of the platen 16, in addition to which it is also pulled up by the take-up side ink ribbon reel 10, which is driven by a motor (not shown), such that it is conveyed without slackness. The printing paper cutter 12 cuts the printing paper at prescribed intervals, but in the case of printing paper of a type where labels are attached to separating paper 4, or the like, the printed labels are often handled together with the separating paper 4, so the cutting function is sometimes not used.

When the rolled printing paper 6 has been used up and the end of the printing paper passes through the detecting section 53 of the paper sensor 23, the support for the detecting section 53 is removed and it moves downwards such that it enters into the groove 71 (FIG. 8), and after a prescribed period of time from operation of the detection sensor 70 (namely, after the time required for the printing paper to move between paper sensor 23 and the platen 16 has elapsed), the printing operation is halted. The printing operation is also halted in cases where the ribbon detection sensor 18 ceases to detect the presence of the ink ribbon 19, for instance, when the ink ribbon 19 breaks, or the like.

The printing head 9 may also be based on a system other than thermal transfer, and the printing paper cutter 12 may be omitted.

In some cases, the guide roller 13 may be positioned on the conveyance path to the paper output side of the platen 16. Furthermore, the guide roller 13 may rotate in a direction other than an upward and downward direction.

What is claimed is:

1. A printing machine comprising:

a conveyance path for conveying printing paper;

a position sensor for detecting a prescribed position of printing paper on the conveyance path; and a printing paper width guide, which is movable in a direction transverse to the conveyance path, for restricting the position of printing paper of a desired width in the direction transverse to the conveyance path, wherein the position sensor is attached to a sliding member constituted such that it can slide in the direction transverse to the conveyance path together with the printing paper width guide.

2. The printing machine according to claim 1, wherein the amount of movement of the position sensor is set to a smaller amount than the amount of movement of the printing paper width guide.

3. The printing machine according to claim 2, wherein the amount of movement of the position sensor is approximately ½ of the amount of movement of the printing paper width guide.

4. The printing machine according to claim 1, wherein the position sensor is constituted such that it is slidable linearly in a direction transverse to the conveyance path, independently of the printing paper width guide, and can be withdrawn to a position where it poses no obstacle when setting printing paper in the conveyance path.

5. The printing machine according to claim 1, wherein the position sensor defines a gap through which printing paper passes by means of an upper portion and a lower portion and is constituted such that a light-emitting element and a light-receiving element are located in opposing positions on either side of this gap.

6. The printing machine according to claim 4, wherein the position sensor is normally held towards the conveyance path away from its withdrawn position by means of a spring.

7. The printing machine according to claim 1, further comprising a guide roller positioned in the direction transverse to the conveyance path and a paper sensor for detecting the presence or absence of printing paper.

8. The printing machine according to claim 7, wherein the position sensor, the printing paper width guide, the paper sensor and the guide roller are positioned along the conveyance path from the downstream side of the conveyance path to the upstream side of the conveyance path.

9. The printing machine according to claim 8, wherein the paper sensor is constituted such that it is withdrawn from the conveyance path upon withdrawal of the guide roller from the conveyance path.

10. The printing machine according to claim 9, wherein the portion of the conveyance path comprising the position sensor, the printing paper width guide, the paper sensor and the guide roller is formed in an approximately linear shape.

11. The printing machine according to claim 10, wherein the guide roller is constituted such that it can be withdrawn from the conveyance path by attaching one end thereof rotatably in a vertical direction to a frame side member.

12. The printing machine according to claim 11, wherein the paper sensor comprises a detecting section and a supporting section, the detecting section contacts the printing paper, is displaced when printing paper ceases to be present, and detects the presence or absence of the printing paper, or the position of a prescribed portion of the printing paper, and the supporting section is constituted such that an electric switch is actuated when it rotates about a roller shaft of the guide roller.

13. The printing machine according to claim 10, wherein the detecting section of the paper sensor has the shape of a lever in a transverse direction to the conveyance path and falls into a transverse groove provided in the conveyance path when the end of the printing paper passes.

14. The printing machine according to claim 13, wherein the guide roller is provided, on the opposite side of a fulcrum of vertical rotation, with locking members for preventing the guide roller from rising up with respect to the frame.

15. The printing machine according to claim 14, wherein the guide roller is held stably in position in both the upper position and lower position of vertical movement by means of a reversing spring.

16. A printing machine which comprises a conveyance path for conveying printing paper, and further comprises, on said conveyance path, a position sensor for detecting a prescribed position of printing paper, a printing paper width guide which is movable in a direction transverse to said conveyance path and which restricts the position of printing paper of a desired width in said transverse direction, a paper sensor, and a guide roller arranged in said transverse direction, wherein a portion of said conveyance path comprising said position sensor, said printing paper width guide, said paper sensor and said guide roller is formed in an approximately linear shape, and wherein said position sensor, said printing paper width guide, said paper sensor and said guide roller are positioned along said conveyance path from a downstream side of said conveyance path to an upstream side of said conveyance path.

* * * * *